US012318888B2

(12) United States Patent
Kikuchi et al.

(10) Patent No.: US 12,318,888 B2
(45) Date of Patent: Jun. 3, 2025

(54) POLISHING APPARATUS AND POLISHING METHOD

(71) Applicant: Kioxia Corporation, Tokyo (JP)

(72) Inventors: Takeshi Kikuchi, Yokkaichi Mie (JP); Takayuki Nakayama, Yokkaichi Mie (JP); Masayoshi Adachi, Yokkaichi Mie (JP); Daisuke Sugiyama, Yokkaichi Mie (JP)

(73) Assignee: Kioxia Corporation, Tokyo (JP)

( * ) Notice: Subject to any disclaimer, the term of this patent is extended or adjusted under 35 U.S.C. 154(b) by 335 days.

(21) Appl. No.: 17/929,128

(22) Filed: Sep. 1, 2022

(65) Prior Publication Data

US 2023/0294234 A1 Sep. 21, 2023

(30) Foreign Application Priority Data

Mar. 17, 2022 (JP) ..... 2022-043075

(51) Int. Cl.
*B24B 9/00* (2006.01)

(52) U.S. Cl.
CPC ..... *B24B 9/00* (2013.01)

(58) Field of Classification Search
CPC ..... B24B 21/002; B24B 21/18; B24B 9/065; B24B 21/004; B24B 55/08; B24B 55/02; B24B 57/02
See application file for complete search history.

(56) References Cited

U.S. PATENT DOCUMENTS

| | | | | |
|---|---|---|---|---|
| 5,733,181 | A * | 3/1998 | Hasegawa | B24B 21/002 451/168 |
| 6,558,239 | B2 * | 5/2003 | Kunisawa | B24B 49/12 451/303 |
| 7,758,404 | B1 * | 7/2010 | Ryder | B24B 9/065 451/526 |
| 10,632,588 | B2 | 4/2020 | Nakanishi et al. | |
| 2004/0185751 | A1 * | 9/2004 | Nakanishi | B24B 21/002 451/6 |
| 2009/0017730 | A1 * | 1/2009 | Kubota | B24B 9/065 451/41 |
| 2010/0136886 | A1 * | 6/2010 | Hongo | B24B 9/065 451/6 |
| 2011/0003540 | A1 * | 1/2011 | Takahashi | B24B 9/065 451/303 |

(Continued)

FOREIGN PATENT DOCUMENTS

| | | | |
|---|---|---|---|
| JP | 2008-36784 | A | 2/2008 |
| JP | 2013161922 | A * | 8/2013 |

(Continued)

*Primary Examiner* — Joel D Crandall
(74) *Attorney, Agent, or Firm* — Finnegan, Henderson, Farabow, Garrett & Dunner, LLP

(57) ABSTRACT

A polishing apparatus is configured to polish a peripheral edge of an object. The apparatus includes: a stage having a mounting surface to mount the object; a polishing head configured to press a polishing surface against the peripheral edge and polish the peripheral edge; a first inlet configured to supply liquid to the polishing surface; and a protector having a first surface extending along a first direction intersecting with the mounting surface, the first surface having an opening between the stage and the polishing head in a second direction intersecting with the first direction.

17 Claims, 6 Drawing Sheets

(56) References Cited

U.S. PATENT DOCUMENTS

| | | | | |
|---|---|---|---|---|
| 2011/0217906 | A1* | 9/2011 | Nakanishi | B24B 9/065 451/28 |
| 2021/0402562 | A1* | 12/2021 | Yamanobe | B08B 1/30 |

FOREIGN PATENT DOCUMENTS

| | | | |
|---|---|---|---|
| JP | 2018-94715 | A | 6/2018 |
| JP | 6929206 | B2 | 9/2021 |
| JP | 6941008 | B2 | 9/2021 |
| TW | 202210229 | A | 3/2022 |

* cited by examiner

POLISHING APPARATUS AND POLISHING METHOD

CROSS-REFERENCE TO RELATED APPLICATION

This application is based upon and claims the benefit of priority from Japanese Patent Application No. 2022-043075, filed on Mar. 17, 2022; the entire contents of which are incorporated herein by reference.

FIELD

Embodiments relate to a polishing apparatus and a polishing method.

BACKGROUND

In recent years, known process examples in a method of manufacturing a semiconductor device include polishing a peripheral edge of an object to be polished such as a wafer to remove projections.

DETAILED DESCRIPTION

Figure 1:
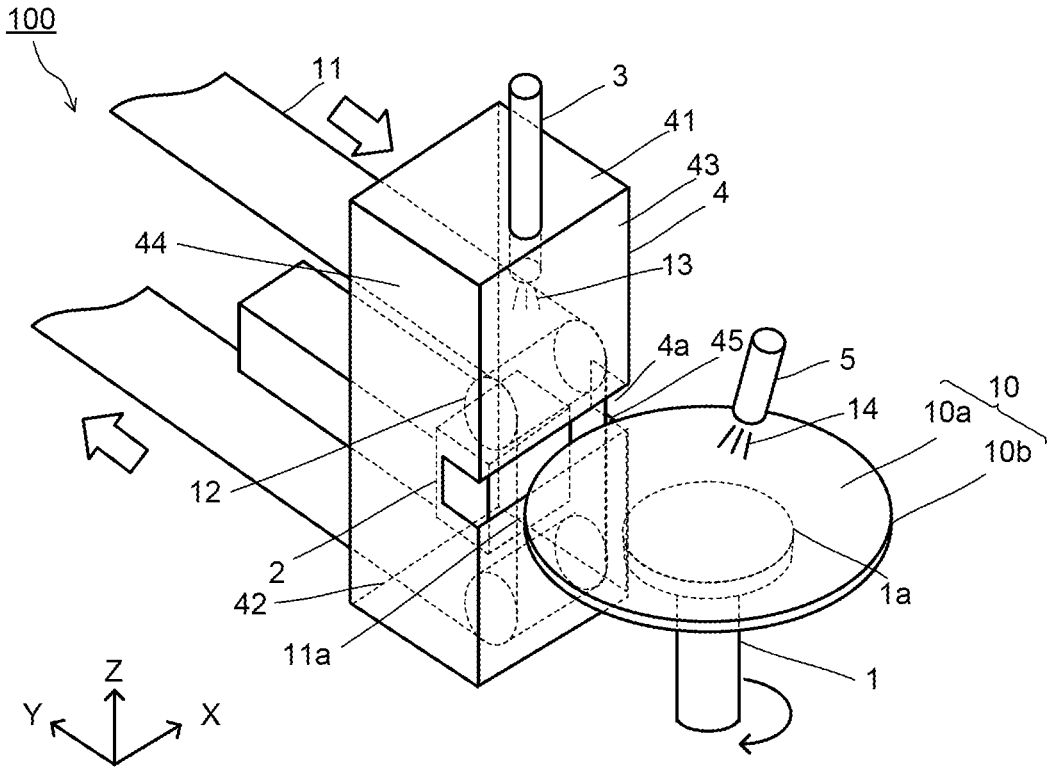
FIG. 1 is a schematic view illustrating a configuration example of a polishing apparatus.

A polishing apparatus in an embodiment is configured to polish a peripheral edge of an object. The apparatus includes: a stage having a mounting surface to mount the object; a polishing head configured to press a polishing surface against the peripheral edge and polish the peripheral edge; a first inlet configured to supply liquid to the polishing surface; and a protector having a first surface extending along a first direction intersecting with the mounting surface, the first surface having an opening between the stage and the polishing head in a second direction intersecting with the first direction.

Hereinafter, embodiments will be explained with reference to the drawings. The relation between the thickness and planar dimensions of each component illustrated in the drawings, a thickness ratio among the components, and so on may be different from actual ones. Further, in the embodiments, substantially the same components are denoted by the same reference sign, and the explanation thereof will be omitted when appropriate.

Configuration Examples of a Polishing Apparatus

Figure 2:
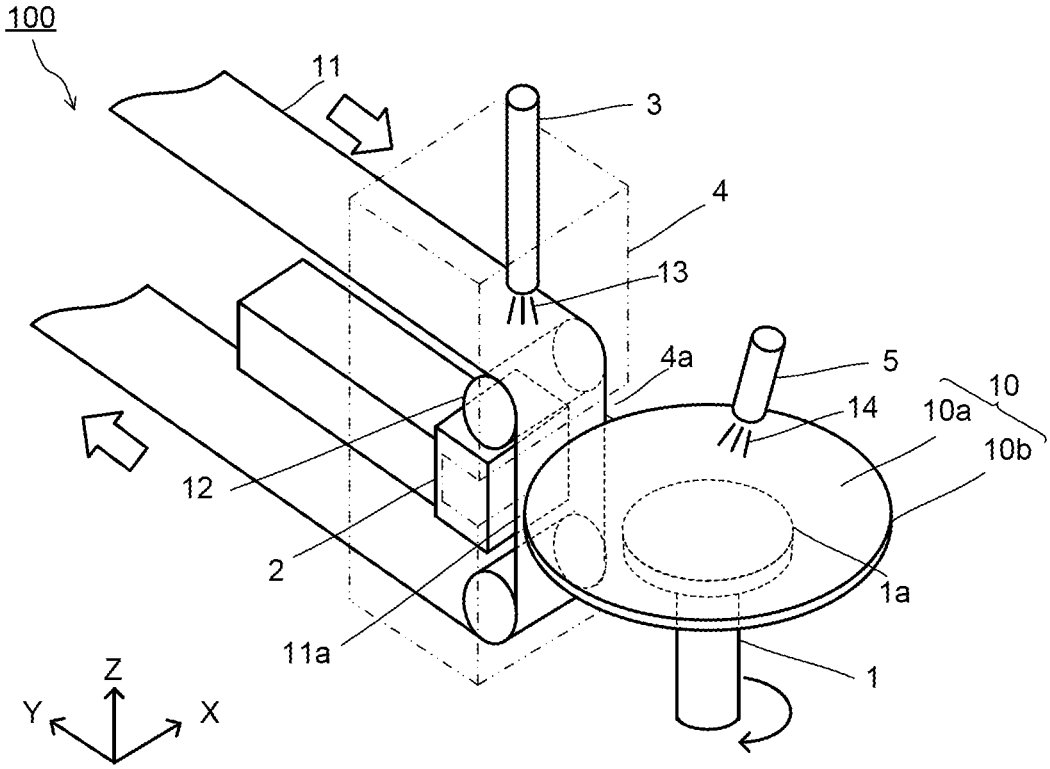
FIG. 2 is a schematic view illustrating the configuration example of the apparatus.
Figure 3:
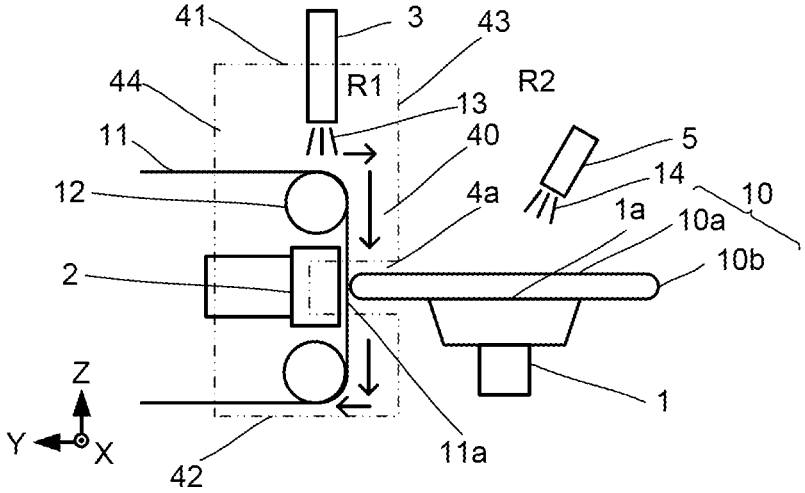
FIG. 3 is a schematic view illustrating the configuration example of the apparatus.
Figure 4:
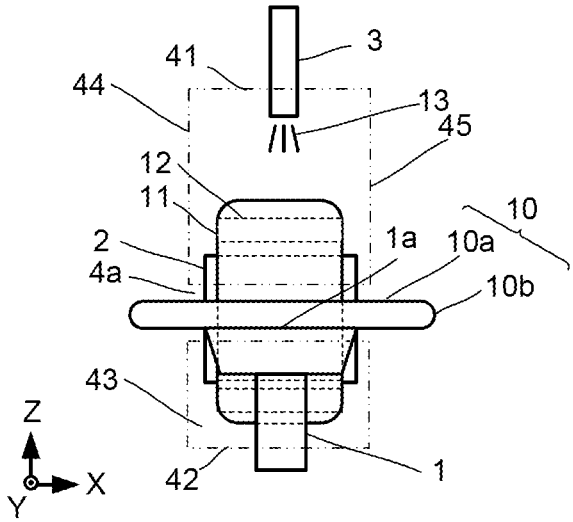
FIG. 4 is a schematic view illustrating the configuration example of the apparatus.
Figure 5:
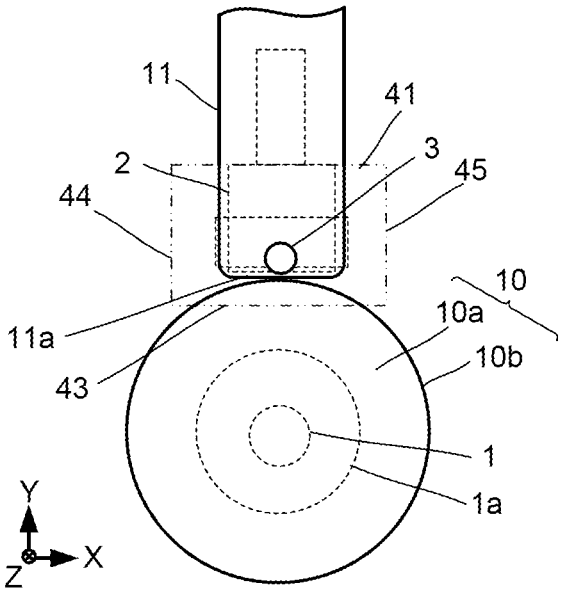
FIG. 5 is a schematic view illustrating the configuration example of the apparatus.

FIG. 1 to FIG. 5 are schematic views illustrating a configuration example of a polishing apparatus. FIG. 1 and FIG. 2 are perspective views including an X-axis, a Y-axis perpendicular to the X-axis, and a Z-axis perpendicular to the X-axis and the Y-axis. FIG. 3 is a side view from the X-axis. FIG. 4 is a front view from the Y-axis. FIG. 5 is a top view from the Z-axis.

A polishing apparatus 100 has a function of polishing a peripheral edge of a polishing object 10, and includes a stage 1, a polishing head 2, an inlet 3, a protector 4, and an inlet 5. FIG. 2 to FIG. 5 illustrate the protector 4 by a two-dotted chain line for convenience.

The stage 1 has a function of rotating the polishing object 10 around, for example, a center axis in the Z-axis direction of the stage 1 as a rotation axis. The stage 1 may be driven, for example, by a drive device having a motor. The stage 1 has a surface (mounting surface) la on which the polishing object 10 is to be mounted. The X-axis and the Y-axis extend, for example, in directions parallel to the surface 1*a*. The Z-axis intersects, for example, with the surface 1*a*.

An example of the polishing object 10 is a semiconductor substrate such as a silicon wafer. The semiconductor substrate may have an insulating film and a conductive film which are provided on the substrate. The polishing object 10 has a pattern formation surface 10*a* and a peripheral edge 10*b*.

The pattern formation surface 10*a* has a pattern including recessed portions or projecting portions. Examples of the pattern include a line-and-space pattern, a hole pattern, and so on. The peripheral edge 10*b* may have a side surface such as a flat surface or a curved surface, or a bevel.

When polishing the peripheral edge 10*b* of the polishing object 10, the polishing head 2 overlaps on the peripheral edge 10*b*, for example, in the Y-axis direction. The polishing head 2 overlaps on the surface 1*a*, for example, in the Y-axis direction. The polishing head 2 has a function of pressing a polishing surface 11*a*, which is a portion in contact with the peripheral edge 10*b*, against the peripheral edge 10*b* to polish the peripheral edge 10*b*. The polishing head 2 may be movable, for example, along the Y-axis direction. The polishing head 2 may be driven, for example, by a drive device including a motor.

The polishing surface 11*a* is provided, for example, on the surface of a polishing tape 11 and has a rough surface. The polishing tape 11 is moved by a plurality of rollers 12. The rollers 12 may be driven, for example, by a drive device having a motor. The polishing surface 11*a* is not limited to the above but may be provided on the surface of a grindstone without using the polishing tape 11. The grindstone may be attached, for example, to a tip of the polishing head 2.

Examples of the polishing tape 11 include a nonwoven polishing tape, an abrasive grain polishing tape, and so on. The abrasive grain tape may have an abrasive grain, for example, of diamond, silicon carbide, cubic boron nitride, boron carbide, aluminum oxide, or the like.

The inlet 3 may be provided, for example, above the polishing head 2. The inlet 3 may be formed by a pipe having a function of supplying (inflowing) liquid 13 to the polishing surface 11*a*. Examples of the liquid 13 include water. The flow rate of the liquid 13 may be controlled, for example, by a mass flow controller connected to the inlet 3. The apparatus 100 may have an outlet for draining the liquid 13.

The protector 4 is provided for protecting, for example, the pattern formation surface 10*a* of the polishing object 10 from the liquid 13. The protector 4 has an upper surface 41, a lower surface 42, a front surface 43, a left side surface 44, and a right side surface 45.

The upper surface 41 and the lower surface 42 extend along the X-axis direction and the Y-axis direction, and are provided to sandwich the polishing tape 11, the rollers 12, and the polishing head 2, therebetween in the Z-axis direction. The protector 4 may be formed such that the inlet 3 penetrates the upper surface 41.

The front surface 43 extends along the X-axis direction and the Z-axis direction, and has an opening 4*a* between the surface 1*a* of the stage 1 and the polishing head 2 in the Y-axis direction. The front surface 43 may overlap, for example, on the rollers 12, the inlet 3, and the inlet 5 in the Y-axis direction. The width in the Z-axis direction of the opening 4*a* is larger than, for example, the thickness of the polishing object and smaller than the width in the Z-axis direction of the polishing head 2. The width in the X-axis direction of the opening 4*a* is not particularly limited as long as a part of the peripheral edge 10*b* of the polishing object 10 can pass therethrough. The opening 4*a* may extend from the front surface 43 to the left side surface 44 and the right side surface 45.

The left side surface 44 and the right side surface 45 extend along the Y-axis direction and the Z-axis direction, and are provided to sandwich the polishing tape 11, the rollers 12, and the polishing head 2, therebetween in the X-axis direction. A part of the peripheral edge 10*b* of the polishing surface 11*a* is exposed from the protector 4 by the opening 4*a*. The material of the protector 4 is not particularly limited as long as the liquid 13 does not pass therethrough, and examples thereof include a resin material such as polyvinyl chloride, polyethylene, polystyrene, and the like.

In the case of polishing the peripheral edge 10*b* using the polishing tape 11, the front surface 43 and the polishing tape 11 define therebetween a flow path 40 through which the liquid 13 can pass. The protector 4 is provided in a manner to partially separate a region R1 having the polishing head 2 and the flow path 40 and a region R2 having the stage 1. This prevents the liquid 13 from flowing, for example, to the pattern formation surface 10*a* of the polishing object 10. Arrows in the flow path 40 in FIG. 3 indicate a direction in which the liquid 13 flows. The flow path 40 may be formed to extend also between the upper surface 41 and the polishing tape 11 and between the lower surface 42 and the polishing tape 11. This can increase the contact area between the polishing tape 11 and the liquid 13.

Figure 6:
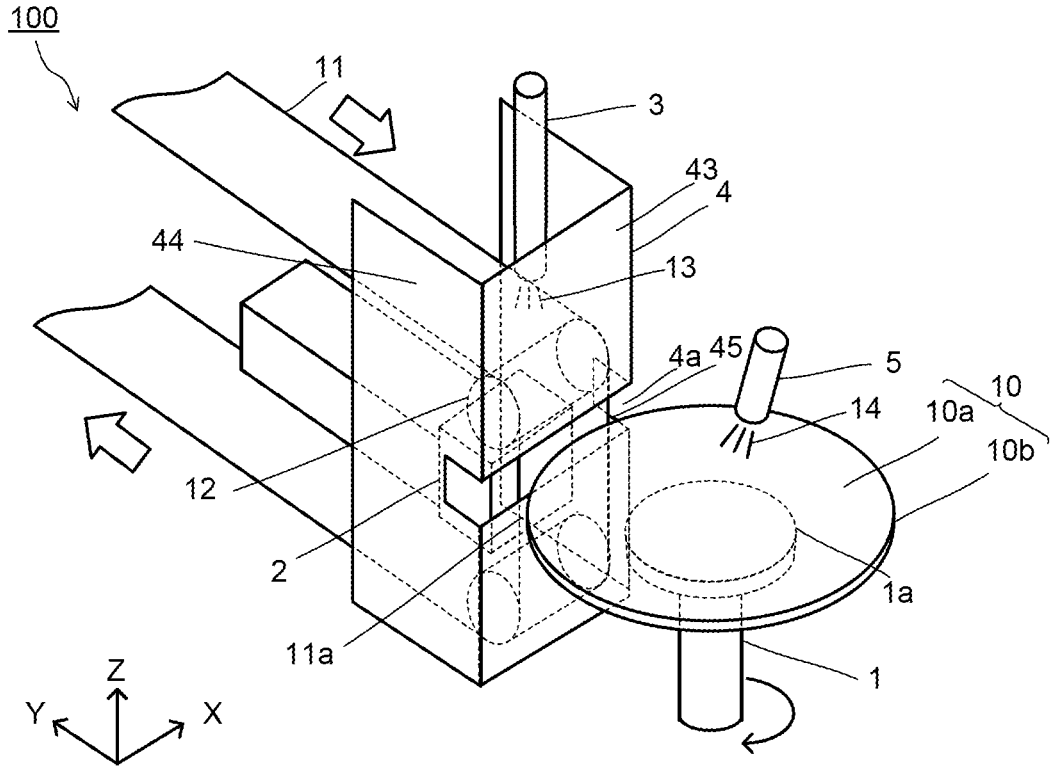
FIG. 6 is a schematic view illustrating another configuration example of the apparatus.
Figure 7:
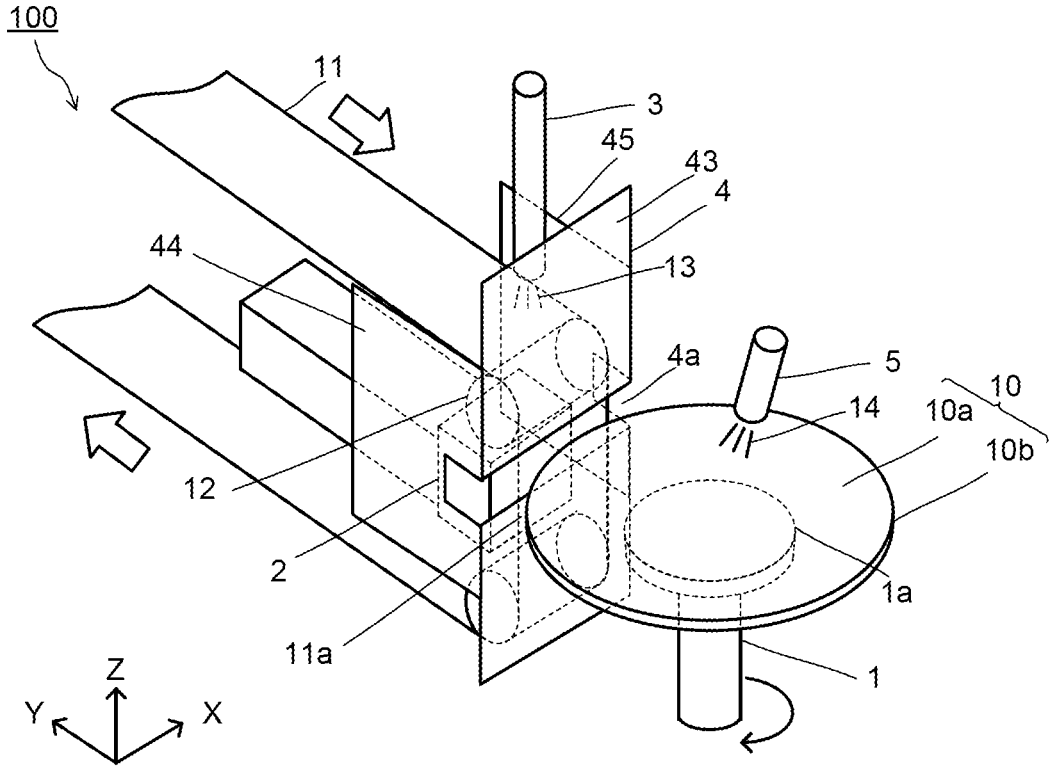
FIG. 7 is a schematic view illustrating another configuration example of the apparatus.

The shape of the protector 4 is not limited to the shape illustrated in FIG. 1 to FIG. 5. FIG. 6 and FIG. 7 are schematic views illustrating other configuration examples of the apparatus, and are perspective views including the X-axis, the Y-axis, and the Z-axis. The protector 4 illustrated in FIG. 6 does not have the upper surface 41 and the lower surface 42. The protector 4 illustrated in FIG. 7 does not have the upper surface 41 and the lower surface 42 and does not have a part of the left side surface 44 and a part of the right side surface 45, and each of surface areas of the left side surface 44 and the right side surface 45 is smaller than the surface area of the front surface 43. The left side surface 44 and the right side surface 45 do not have to overlap on some of the rollers 12 in the X-axis direction. As illustrated in FIG. 6 and FIG. 7, at least a part of at least one surface of the protector 4 is omitted to decrease the surface area of the protector 4, and thereby the cost of the protector 4 can be reduced. For the other explanation, the explanation of FIG. 1 to FIG. 5 can be employed as appropriate.

The inlet 5 is provided, for example, above the stage 1. In FIG. 4 and FIG. 5, the illustration of the inlet 5 is omitted for convenience. The inlet 5 is a pipe having a function of supplying (inflowing) gas 14 to be sprayed to the pattern formation surface 10*a* of the polishing object 10. Examples of the gas 14 include nitrogen and air. The flow rate of the gas 14 may be controlled, for example, by a mass flow controller connected to the inlet 5.

The stage 1, the polishing head 2, the supply of the liquid 13 from the inlet 3, and the supply of the gas 14 from the inlet 5 may be controlled, for example, by a control circuit. The control circuit may be configured using, for example, hardware using a processor or the like. Each operation may be held as an operation program on a computer-readable recording medium such as a memory, and the operation program stored on the recording medium may be read when necessary by the hardware to execute each operation.

(Polishing Method)

Figure 8:
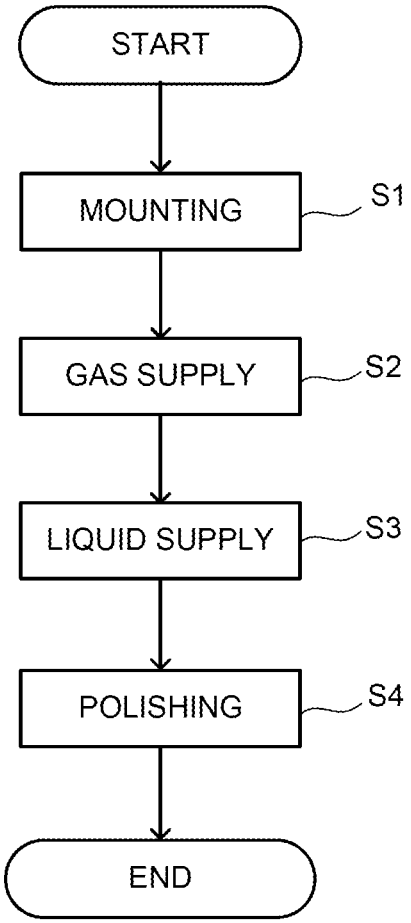
FIG. 8 is a flowchart for explaining an example of a polishing method using a polishing apparatus 100.

FIG. 8 is a flowchart for explaining an example of the polishing method using the apparatus 100. The example of the polishing method includes a mounting step S1, a gas supply step S2, a liquid supply step S3, and a polishing step S4 as illustrated in FIG. 8.

[Mounting Step S1]

An example of the mounting step S1 includes mounting the polishing object 10 on the surface 1*a* of the stage 1. The surface 1*a* is in contact with a surface on the opposite side of the polishing object 10 from the pattern formation surface 10*a*. The polishing object 10 may be mounted on the surface 1*a* using, for example, a carrier device such as a robot arm. The carrier device may be controlled by the control circuit.

[Gas Supply Step S2]

An example of the gas supply step S2 includes spraying the gas 14 from the inlet 5 to the pattern formation surface 10*a*.

[Liquid Supply Step S3]

An example of the liquid supply step S3 includes supplying the liquid 13 from the inlet 3. The supplied liquid 13 flows as the arrows in FIG. 3 through the flow path 40 formed by the protector 4.

[Polishing Step S4]

An example of the polishing step S4 includes rotating the polishing object 10 by the stage 1 and moving the polishing head 2 in the Y-axis direction to press the polishing surface 11*a* against the peripheral edge 10*b* of the polishing object 10 by the polishing head 2, and accordingly polishing the peripheral edge 10*b*. The polishing is performed through the opening 4*a* of the protector 4.

As explained above, at the polishing step S4, the polishing the peripheral edge 10*b* of the polishing object 10 can remove projections. If the projections exist, the projections may break to form particles at subsequent steps. The particles, if adhering, for example, to the pattern formation surface 10*a*, cause harm such as operation failure of, for example, a semiconductor device to be manufactured using the polishing object 10. Therefore, the polishing the peripheral edge 10*b* can prevent harm to the pattern formation surface 10*a*.

Further, at the polishing step S4, the peripheral edge 10*b* of the polishing object 10 is polished while the liquid 13 is being supplied to the polishing surface 11*a*. If the liquid 13 flows to the pattern formation surface 10*a*, the liquid 13 is likely to cause harm such as the deformation, collapse or the like of the pattern. This likely to occur with a higher aspect ratio of the projecting portions or the recessed portions contained in the pattern (the ratio of the depth or the height to the width in the X-axis direction or the Y-axis direction).

Alternatively, if the polishing object 10 is polished without supplying the liquid 13, dust becomes more likely to adhere to the pattern formation surface 10*a*. This causes harm such as operation failure of, for example, a semiconductor device to be manufactured using the polishing object 10.

In contrast to the above, the apparatus and the polishing method in the embodiments can prevent the liquid 13 from flowing to the pattern formation surface 10*a* by supplying the liquid 13 to the polishing surface 11*a* using the protector 4. This can prevent the deformation and collapse of the pattern and thus prevent harm to the pattern formation surface 10*a*. A larger contact area between the polishing tape 11 and the liquid 13 can further prevent the generation of dust.

Further, the apparatus and the polishing method in the embodiments can prevent the dust from scattering onto the pattern formation surface 10*a* by spraying the gas 14 to the pattern formation surface 10*a*. Further, even if the liquid 13 adheres to the pattern formation surface 10*a*, the pattern formation surface 10*a* can be dried.

Modified Example of the Apparatus

Figure 9:
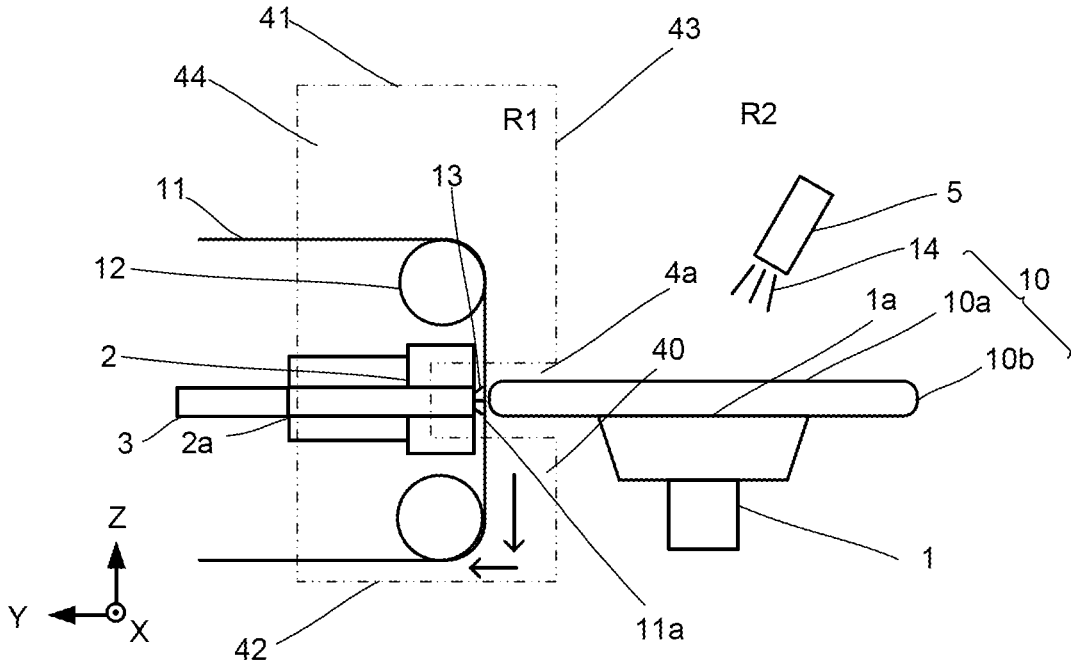
FIG. 9 is a schematic view illustrating a modified example of the apparatus.
Figure 10:
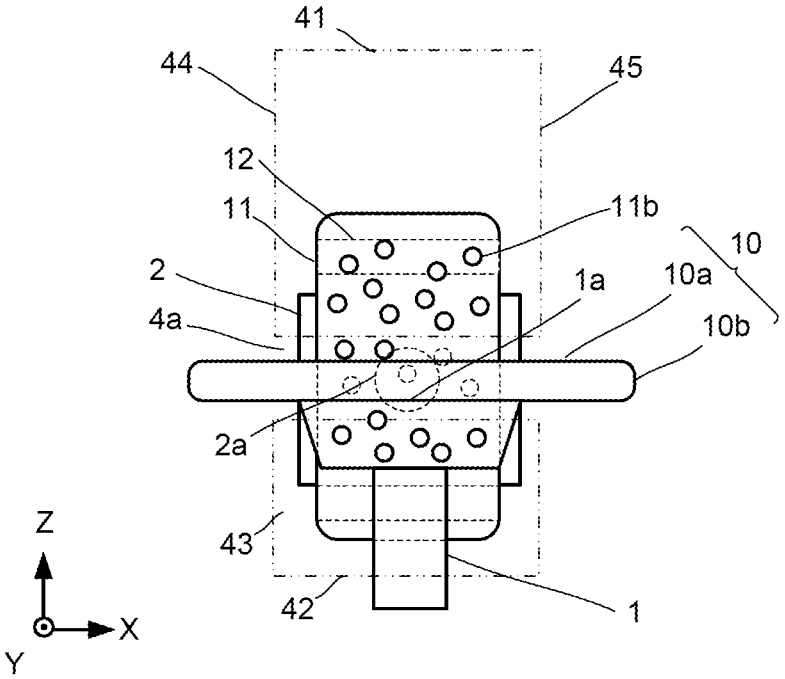
FIG. 10 is a schematic view illustrating the modified example of the apparatus.

FIG. 9 and FIG. 10 are schematic views illustrating a modified example of the apparatus. FIG. 9 is a side view from the X-axis direction. FIG. 10 is a front view from the Y-axis direction. A polishing apparatus 100 has a function of polishing a peripheral edge 10*b* of a polishing object 10, and includes a stage 1, an inlet 3, a polishing head 2, a protector 4, and an inlet 5. The stage 1, the protector 4, and the inlet 5 are the same as the stage 1, the protector 4, and the inlet 5 of the apparatus illustrated in FIG. 1 to FIG. 5, respectively, and therefore their explanation is omitted here and the explanation of FIG. 1 to FIG. 5 is employed as appropriate.

The polishing head 2 has an opening 2*a* extending therein along the Y-axis direction. The opening 2*a* is connected, for example, to the inlet 3 provided in a manner to overlap on the polishing head 2 in the Y-axis direction. In this case, the flow path 40 is formed from between the stage 1 and the polishing head 2 to between the polishing tape 11 and the polishing surface 11*a*. For the other explanation of the inlet 3 and others, the explanation of FIG. 1 to FIG. 5 is employed as appropriate.

The polishing tape 11 has, at the polishing surface 11*a*, an opening 11*b* penetrating the polishing tape 11. FIG. 10 illustrates a plurality of openings 11*b*, but the number of openings 11*b* is not particularly limited. An average pore size of the opening 11*b* is not particularly limited as long as the liquid 13 can pass therethrough, and the shape of the opening 11*b* at the polishing surface 11*a* is, for example, a circle.

In the case of polishing the peripheral edge 10*b* using the polishing tape 11 having the openings 11*b*, the front surface 43 and the polishing tape 11 define therebetween a flow path 40 through which the liquid 13 can pass. The protector 4 is provided in a manner to partially separate a region R1 having the polishing head 2 and the flow path 40 and a region R2 having the stage 1. This prevents the liquid 13 from flowing, for example, to the pattern formation surface 10*a* of the polishing object 10. Arrows in the flow path 40 in FIG. 9 indicate a direction in which the liquid 13 flows. The flow path 40 may be formed to extend also between the lower surface 42 and the polishing tape 11. This can increase the contact area between the polishing tape 11 and the liquid 13.

An example of the polishing method using the modified example of the apparatus includes a mounting step S1, a gas supply step S2, a liquid supply step S3, and a polishing step S4 as in FIG. 8. The mounting step S1, the gas supply step S2, and the polishing step S4 are the same as the mounting step S1, the gas supply step S2, and the polishing step S4 illustrated in FIG. 8, and therefore the explanation is omitted here and the explanation in FIG. 8 is employed as appropriate.

An example of the liquid supply step S3 includes supplying the liquid 13 from the inlet 3. The supplied liquid 13 is supplied to the polishing surface 11*a* through the opening 2*a* and the openings 11*b*, and flows as the arrows in FIG. 9 through the flow path formed by the protector 4.

The modified example of the apparatus prevents the liquid from flowing to the pattern formation surface 10*a* by using the protector 4 and supplying the liquid 13 through the opening 2*a* extending inside the polishing head 2 and passing the liquid 13 through the openings 11*b* of the polishing tape 11 to supply the liquid 13 to the polishing surface 11*a*. This can prevent deformation or collapse of the pattern.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A polishing apparatus configured to polish a peripheral edge of an object, the apparatus comprising:
- a stage having a mounting surface to mount the object;
- a polishing head configured to press a polishing surface against the peripheral edge and polish the peripheral edge;
- a first inlet configured to supply liquid to the polishing surface; and
- a protector having a first surface extending along a first direction intersecting with the mounting surface, the first surface having an opening between the stage and the polishing head in a second direction intersecting with the first direction, wherein:
- the polishing surface is provided on a polishing tape having a first opening; and
- the polishing head has a second opening connected to the first inlet and extending through the polishing head in the second direction.

2. The apparatus according to claim 1, further comprising
- a second inlet provided above the stage and configured to supply gas to be sprayed onto a surface of the object on which a pattern is formed.

3. The apparatus according to claim 1, wherein:
- the first inlet is provided above the polishing head;
- the polishing surface is provided on a polishing tape; and
- the polishing tape and the first surface define therebetween a flow path through which the liquid passes.

4. The apparatus according to claim 1, wherein
- a width of the first opening in the first direction is larger than a thickness of the object and is smaller than a width of the polishing head in the first direction.

5. A polishing apparatus configured to polish a peripheral edge of an object, the apparatus comprising:
- a stage having a mounting surface to mount the object;

a polishing head configured to press a polishing surface against the peripheral edge and polish the peripheral edge;

a first inlet configured to supply liquid to the polishing surface; and a protector having a front surface extending along a first direction intersecting with the mounting surface, the front surface having an opening between the stage and the polishing head in a second direction intersecting with the first direction, a first side surface extending along the second direction, and a second side surface extending along the second direction, the polishing head is provided between the first side surface and the second side surface in a third direction intersecting the second direction, wherein the protector further has an upper surface provided above the polishing head and having the first inlet, and a lower surface provided under the polishing head.

6. The apparatus according to claim 5, wherein, an area of each of the first and second side surfaces is smaller than an area of the front surface.

7. The apparatus according to claim 5, further comprising a second inlet provided above the stage and configured to supply gas to be sprayed onto a surface of the object on which a pattern is formed.

8. The apparatus according to claim 5, wherein:

the polishing surface is provided on a polishing tape; and the polishing tape and the first surface define therebetween a flow path through which the liquid passes.

9. The apparatus according to claim 5, wherein, a width of the first opening in the first direction is larger than a thickness of the object and is smaller than a width of the polishing head in the first direction.

10. The apparatus according to claim 5, further comprising a roller configured to move the polishing tape through a space between the polishing head and the front surface.

11. A polishing apparatus configured to polish a peripheral edge of an object, the apparatus comprising:

a stage having a mounting surface to mount the object;

a polishing head configured to press a polishing surface against the peripheral edge and polish the peripheral edge;

a first inlet configured to supply liquid to the polishing surface; and a protector having a front surface extending along a first direction intersecting with the mounting surface, the front surface having an opening between the stage and the polishing head in a second direction intersecting with the first direction, a first side surface extending along the second direction, and a second side surface extending along the second direction, the polishing head is provided between the first side surface and the second side surface in a third direction intersecting the second direction, wherein:

the polishing surface is provided on a polishing tape having a first opening; and the polishing head has a second opening connected to the first inlet and extending through the polishing head in the second direction.

12. A polishing method for polishing a peripheral edge of an object, the polishing method comprising:

mounting the object onto a mounting surface of a stage;

supplying a liquid onto a polishing surface; and pressing the polishing surface against the peripheral edge by a polishing head through a protector, and polishing the peripheral edge, the protector having a first surface extending along a first direction intersecting with the mounting surface, the first surface having an opening between the stage and the polishing head in a second direction intersecting with the first direction, wherein the liquid is supplied onto a polishing surface without the liquid being supplied onto a surface of the object on which a pattern is formed.

13. The method according to claim 12, further comprising spraying gas onto the surface of the object before supplying the liquid onto the polishing surface.

14. The method according to claim 13, wherein, the liquid is supplied onto a polishing surface with the gas being sprayed onto the surface of the object.

15. The method according to claim 13, wherein, the peripheral edge is polished with the object being rotated by the stage.

16. The method according to claim 12, wherein, the object has a semiconductor substrate having the surface and the peripheral edge of the object.

17. The method according to claim 16, wherein, the surface of the object has a pattern.

* * * * *